United States Patent [19]

Stewart

[11] 3,965,585

[45] June 29, 1976

[54] SHOE ATTACHMENT FOR SPORTS

[76] Inventor: Sherwin R. Stewart, 5844 Denny Ave., North Hollywood, Calif. 91601 5N

[22] Filed: Aug. 7, 1975

[21] Appl. No.: 602,682

[52] U.S. Cl. ..... 36/125
[51] Int. Cl.[2] ..... A43B 00/00
[58] Field of Search..... 36/2.5 R, 2.5 AA, 2.5 AB

[56] References Cited

UNITED STATES PATENTS

| | | | |
|---|---|---|---|
| 1,059,565 | 4/1913 | Robinson | 36/2.5 AA |
| 2,412,474 | 12/1946 | Scott-Paine et al. | 36/2.5 AA |
| 3,861,698 | 1/1975 | Greig | 36/2.5 AB |

*Primary Examiner*—Patrick D. Lawson
*Attorney, Agent, or Firm*—Roger A. Marrs

[57] ABSTRACT

A shoe attachment device is disclosed herein for use in a variety of sporting activities which comprises an elongated platform or foot support member having a flat bottom surface and an upwardly extending continuous sidewall carried in parallel along the opposite side edges and along the front edge. A stiffening rod is incorporated into the front wall for reinforcement purposes. Detachable runners are carried on the platform and downwardly project from the underside thereof for ground engaging purposes. The upper surface of the platform carries a shoe or boot attachment having an adjustable heel securement and an adjustable toe securement whereby the users foot is firmly secured on the platform.

7 Claims, 3 Drawing Figures

SHOE ATTACHMENT FOR SPORTS

BACKGROUND OF THE INVENTION

1. Field of the Invention

This invention relates to shoe attachment devices for a variety of sports and more particularly to a novel such device having detachable runners and adjustment means for accompanying a variety of shoe or foot sizes.

2. Brief Description of the Prior Art

In the past, a variety of footwear has been provided for use in sports whereby the user may slide, walk or otherwise travel over knolled surfaces, sand or other soft or liquid surfaces. Such footwear normally includes runners for snow usage and a smooth under surface for beach surfing or sand walking. However, problems have been encountered with such conventional foot implements or devices which stem largely from the fact that each device may be used only for its intended purpose such as for snow use and such a device does not function well on sand or a beach surf condition. Also, conventional devices do not provide for adjustment of foot size and, in many instances, the device will not accommodate a boot or shoe of the user. In many instances, straps are employed which have been found to be highly undesirable since they require substantially exact measurement for usage since holes must be provided in a strap that are mateable with a hooked member on a buckle.

Therefore, there has been a long standing need to provide a novel foot device having adjustable attachment means for securing to the users foot and which may be employed for a variety of sport purposes such as a snow shoe, sand shoe, walking device or for a surfing device on water or snow.

SUMMARY OF THE INVENTION

Acccordingly, the above problems and difficulties are obviated by the present invention which provides a new and novel shoe attachment for a variety of sports which comprises an elongated platform or foot member having upwardly sloped continuous sidewall which extends about the sides of the platform and across the front end thereof. Reinforcing means are embedded into the sidewalls extending across the front of the platform and the platform further includes detachably mounted running means which downwardly depend from the under surface thereof. Preferably, the runners comprise a pair of elongated projections which are carried on a common plate and attachment means comprises a pair of wing nuts which threadably engage with bolts passing through the platform for attachment purposes. The user's shoe is accommodated into a toe member having a pair of pivoting halves so that the foot may be readily inserted therein and a table heel adjustment means is provided for releasably securing the users foot into the toe member. A feature of the invention resides in releasably securing the heel table and the toe member to the user's foot so that the foot may be released upon inadvertent falling or tipping of the wearer while in use.

Therefore, it is among the primary objects of the present invention to provide a novel foot ski or surfing device which incorporates adjustable attaching means for a user's shoe that may be used in a variety of sport conditions.

Another object of the present invention is to provide a new and novel shoe attachment for a ski device which is adjustable with respect to heel securement and toe securement of the user's boot or shoe to a supporting platform used in connection with sand walking, snow conditions and beach surfing.

A further object of the present invention resides in a novel shoe ski or platform which is economical to manufacture and that may be readily attached to a variety of shoe sizes.

Still a further object of the present invention is to provide a novel shoe or foot attachment device for supporting the user on sand, snow or surf which affords easy adjustment for shoe size and which is easy and safe for use by children or adults alike.

A further object of the present invention is to provide a novel shoe or foot device of the kind described, which is simple in construction, reasonable in cost and efficient in carrying out the purposes for which the attachments are designed.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figures 1, 2, 3:
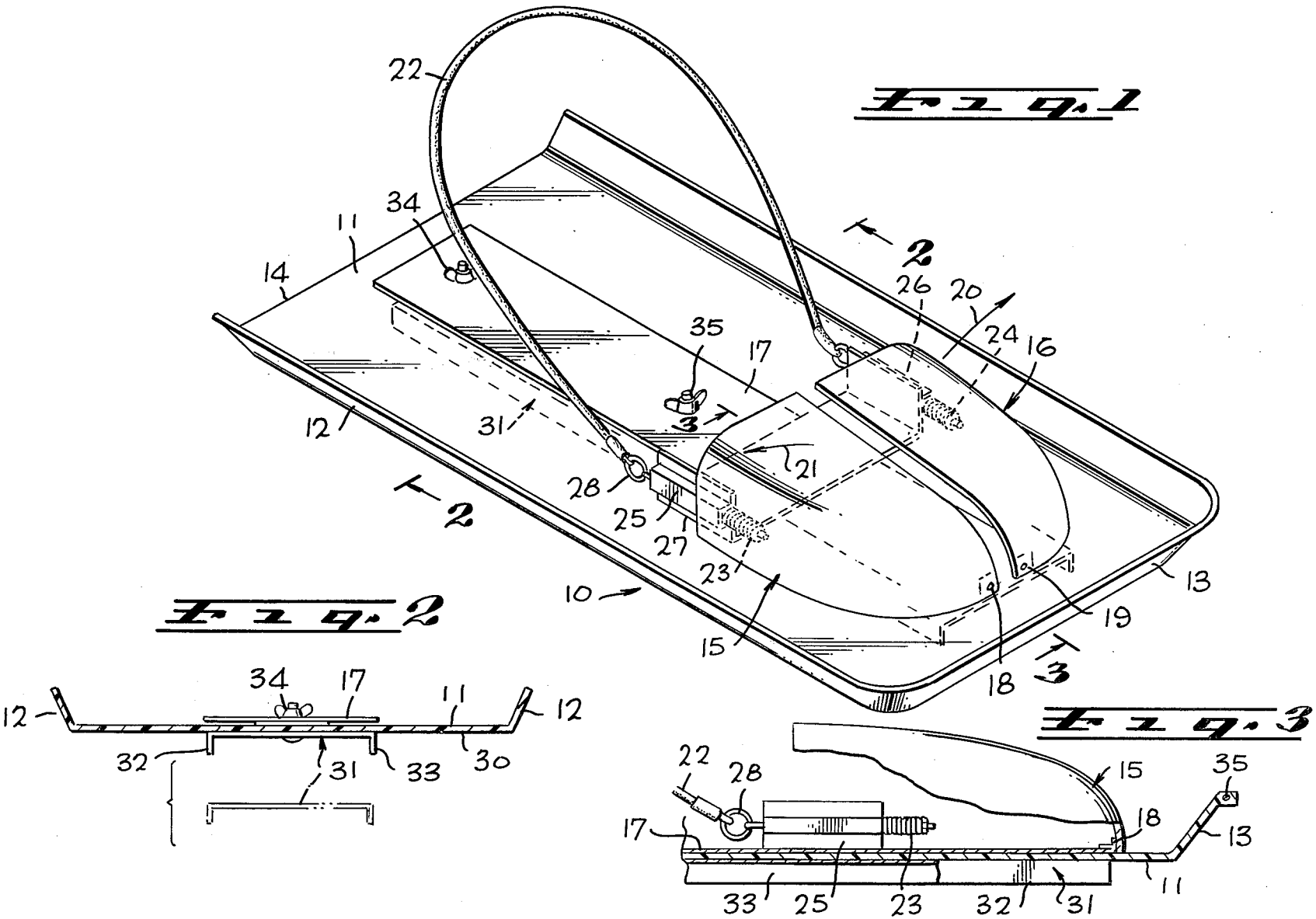
FIG. 1 is a front perspective view of the present invention showing one shoe attachment device of the pair.
FIG. 2 is a transverse cross sectional view of the shoe attachment device illustrated in FIG. 1 and taken in the direction of arrows 2—2 thereof.
FIG. 3 is a partial longitudinal cross sectional viwe taken in the direction of arrows 3—3 of FIG. 1 illustrating the heel and toe attachment means.

Referring to FIG. 1, the novel shoe attachment for sporting activities is indicated in the general direction of arrow 10 and it is to be understood that a pair of such devices are used by the wearer for engagement in the sport whether it be snow, sand walking or beach surfing. The device 10 includes an elongated platform 11 which is open at its rear end and closed about its side and front end by an upwardly sloping continuous sidewall 12. The sidewall 12 extends about the peripheral edge of the platform 11 in parallel with respect to the sides and across the front end of the platform as indicated by numeral 13. It is to be noted that the length of the platform 11 is of sufficient length to accommodate the shoe or boot of the wearer and that it is not intended that the present invention be as long as conventional snow skis. The rear edge 14 is a few inches from the heel of the shoe or boot while the front end 13 is a few inches from the toe of the shoe or boot.

Adjustable attachment means are provided for releasably securing the shoe or boot to the platform 11 and comprise a toe member which includes a pair of pivoting halves indicated by numeral 15 and 16 respectively. A slight space or separation exists between the pair of halves and each half is pivotally mounted on a support plate 17 by pivot brackets 18 and 19 respectively. The toe halves may be pivoted outwardly in the direction of arrows 20 and 21 so as to accommodate the closing of the boot toe or release thereof in the event the person slips or falls while wearing the device. This feature is for safety purposes and prevents injury to the foot or leg of the wearer.

The boot or shoe heel is held in place by means of a cable 22 which is spring loaded at its opposite ends by springs 23 and 24 in cooperation with fixed brackets 25 and 26. The brackets 25 and 26 are carried on the legs of a U-shaped member 27 which is fixedly secured to a portion of the support plate 17. The springs 23 and 24 are each carried on an end of a threaded bolt so that the spring is compressed between one end of a bracket 25 and a nut carried on the opposite end of the bolt. The other end of the bolt carries a loop, such as loop 28 to which one end of the cable 22 is attached. Therefore, it can be seen that a constant tension is placed on the cable 22 to retain the heel and toe in position on the platform. However, should a person fall, stress would be placed on cable 22 which yields because of the spring tension so that no injury would occur.

Referring now to FIG. 2, it can be seen that the platform 11 includes an underside 30 from which a runner member downwardly depends and such a member is indicated by numeral 31. The runner member includes a pair of runners 32 and 33 which are parallel with respect to each other and a feature of the invention in the fact that the runner member 31 is detachably carried on the under surface of the platform 11. As shown in broken lines and indicated by numeral 31', the runner member is detached from the platform which leaves a smooth under surface such as when the device is used for surfing at the beach. The runner member 31 is detachably secured to the platform by means of a pair of wing nuts indicated in FIGS. 1 and 2 by numerals 34 and 35. The wing nuts are threadably secured to bolts which are fixedly carried on the runner member 31 and project through the platform 11. The wing nut 35 is intentionally placed so as to be immediately behind the instep of the wearer's shoe and therefore it will not interfere with the sole or other portion of the footwear.

Referring now in detail to FIG. 3, it again can be seen that the runners extend downwardly from the underside of platform 11 and that the front sidewall 13 projects upwardly. The terminating end of the front wall 13 includes a reinforcing bar 35 which extends across the full length of the sidewall. Preferably, the platform including the sidewalls are integrally formed from a plastic or plastic-like material such as polyurethene which offers a slick surface. The slick surface deters collection of foreign matter or dirt and greatly enhances the sliding characteristics while in use. FIG. 3 also shows the spring-loaded adjustment for the heel cable 22.

In view of the foregoing, it can be seen that the device of the present invention includes a pair of shoe attachment devices of which device 10 is illustrative. Attachment device 10 includes the platform 11 which carries the shoe or boot attaching devices. The toe of the boot is initially placed between the toe halves 15 and 16 and the heel strap 22 is placed around the back of the shoe or boot. The strap 22 will tighten due to the normal bias of the springs 23 and 24 so that the boot is urged forward with respect to the platform. Such construction permits the person using the device to raise his heel from the upper surface of the platform and therefore bend his foot as in normal walking. Also, should the person fall, his foot will dislodge from the toe member due to the pivot of the halves about pivot points 18 and 19 and the heel strap or cable 22 will yield.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A shoe attachment device for use in connection with a variety of sports including snow, beach surf, sand walking and the like comprising a pair of foot devices wherein each of said foot devices consists of:

an elongated platform having opposite ends terminating in close proximity to the toe and heel of the user's shoe;

a continuous sidewall integrally carried on said platform extending in parallel along the opposite sides of said platform;

a portion of said continuous sidewall constituting the front end of said platform and including an outwardly projecting lip;

said lip incasing a length of reinforcement rod so as to stiffen and rigidize said front end;

adjustable attachment means operably carried on said platform for detachably coupling the heel and toe of the user's shoe;

said attachment means including a toe piece having a pair of halves pivotally carried on said platform for lateral rotational movement towards the opposing surfaces of said sidewalls;

parallel runner means detachable carried on the underside of said platform so as to downwardly depend therefrom; and releasing means interconnecting said runner means with said platform for removing and detaching said runner means.

2. The invention as defined in claim 1 wherein said runner means includes an elongated plate carried on the longitudinal centerline of said platform and a pair of runners downwardly depending from said plate.

3. The invention as defined in claim 2 wherein said adjustable attachment means further includes a cable having its opposite ends resiliently secured to a pair of spaced-apart brackets carried on said platform so that the user's shoe may be disposed therebetween and whereby said cable extends about the heel of the user's shoe.

4. The invention as defined in claim 3 whereby said halves of said toe piece are separated from each other so as to provide a gap between the opposing edges thereof.

5. The invention as defined in claim 4 wherein said pair of brackets are carried on opposite ends of a plate extending transversely across said platform and partly covered by said toe piece.

6. The invention as defined in claim 5 wherein said releasing means includes a pair of wing bolts and nuts manually operated to attach and detach said runner means with respect to said platform.

7. The invention as defined in claim 6 including a mounting plate carried on the topside of said platform for supporting said toe piece, said transverse plate and said runner means.

* * * * *